US009089756B1

(12) United States Patent
Kirschberg

(10) Patent No.: US 9,089,756 B1
(45) Date of Patent: Jul. 28, 2015

(54) SPORT SWING TRAINING AID

(71) Applicant: Alvin Kirschberg, Lindenhurst, NY (US)

(72) Inventor: Alvin Kirschberg, Lindenhurst, NY (US)

( * ) Notice: Subject to any disclaimer, the term of this patent is extended or adjusted under 35 U.S.C. 154(b) by 0 days.

(21) Appl. No.: 14/612,563

(22) Filed: Feb. 3, 2015

(51) Int. Cl.
*A63B 69/36* (2006.01)
*A63B 21/02* (2006.01)
*A63B 69/00* (2006.01)

(52) U.S. Cl.
CPC ..... *A63B 69/3632* (2013.01); *A63B 69/0002* (2013.01); *A63B 2069/0008* (2013.01)

(58) Field of Classification Search
USPC ..... 473/219, 226, 256, 257, 280, 294, 295, 473/296, 298, 409; 482/106, 121, 126, 128
See application file for complete search history.

(56) References Cited

U.S. PATENT DOCUMENTS

| | | | | | |
|---|---|---|---|---|---|
| 1,956,498 | A | * | 4/1934 | Duke | 482/126 |
| 2,714,008 | A | | 6/1953 | Urban | |
| 3,761,083 | A | * | 9/1973 | Buchner | 482/126 |
| 4,095,789 | A | | 6/1978 | Mueller | |
| 4,399,996 | A | | 8/1983 | Boyce | |
| 4,623,146 | A | | 11/1986 | Jackson | |
| 4,671,508 | A | | 6/1987 | Tetreault | |
| 4,913,417 | A | | 4/1990 | Francu | |
| 4,978,122 | A | * | 12/1990 | Dibowski | 482/106 |
| 5,106,095 | A | | 4/1992 | Pitkethly | |
| 5,244,442 | A | | 9/1993 | Schill | |
| 5,334,118 | A | | 8/1994 | Dantolan | |
| 5,364,324 | A | | 11/1994 | Boettiger | |
| 5,474,511 | A | | 12/1995 | Dantolan | |
| 6,071,214 | A | | 6/2000 | Osterman | |
| 7,175,575 | B1 | * | 2/2007 | Dantolen | 482/128 |
| 7,297,077 | B1 | | 11/2007 | Battaglino | |
| 7,674,185 | B2 | | 3/2010 | Omidi | |
| 2003/0013563 | A1 | | 1/2003 | Ryan | |
| 2006/0079341 | A1 | | 4/2006 | Mansour | |

* cited by examiner

*Primary Examiner* — Nini Legesse
(74) *Attorney, Agent, or Firm* — Harold G. Furlow, Esq.

(57) ABSTRACT

A swing training apparatus is described that has a cylindrical main shaft that includes an intermediate stop and a pair of end stops. The intermediate stop is located at a predetermined location on the main shaft between the end stops. A pair of grips are connected to and slide on the main shaft. One grip is positioned between the intermediate stop and each of the end stops. A bias mechanism urges the grips towards the intermediate stop. The main shaft includes a channel that guides the travel of the grips on the main shaft. The grips facilitate the kinesthetic training of a two handed swing in sports such as golf and baseball by training the alternating pushing and pulling of the grip along the longitudinal axis of the main shaft.

20 Claims, 5 Drawing Sheets

SPORT SWING TRAINING AID

BACKGROUND OF THE INVENTION

1. Field of the Invention

The present disclosure relates to field of sports training aids and in particular to a sport swing training aid and method of use of that training aid for the enhancement of two-handed swings.

2. Description of the Related Art

Related art to the present disclosure includes weight training exercise devices that employ rods in combination with weights that are moved by the manual axial rotation of the rod. These devices can further include spring resistance to the axial rotation as well as weight resistance. Additional exercise devices include weights on a bar that slide longitudinally relative to the rod based on the movement of the bar by the user.

An additional set of devices are swing aids for one or more sports, but these are typically complex mechanical devices that typically employ springs for articulation and/or a combination of weights and spring. These devices do not emphasize the relative relationship between the hands of the athlete and the relative axial aligned push-pull elements of each hand that are an essential part of the swing process.

There are certain common elements in the swings in different sports even though the grip, distance between the hands and equipment vary from one sport to another. In particular, these sport swings share certain kinesthetics and it is well understood that kinesthetic memory can play an important role in enhancing sports performance. There is a transition in the discipline of athletics from the learning of a skill that requires a seeing, thinking and doing process to a seeing and doing process. This learning process involves muscle training that results in muscle memory where complex athletic skills—such as swinging a baseball bat to connect with a pitch, are trained such that there is muscular action without specific thoughts guiding the muscular actions.

The sport swing training aid provides athletes a balanced approach to placing their hands on the piece of sport equipment that fosters an understanding as to the muscle dynamics that take place during a properly constructed swing. The present disclosure uniquely combines kinesthetic memory development with a training aid that focuses the athlete to build kinesthetic memory for the push-pull action in their grip of the sports equipment. A kinesthetic memory training that can then be directly transferred from the training aid to the athletic equipment on the athletic field. None of the references alone or in combination heretofore have the structure or teach the method of the present disclosure to enhance the sport swing of an athlete.

SUMMARY OF THE INVENTION

A sport swing training aid or training apparatus is described that comprises a main shaft, grips and a bias mechanism. The main shaft has a cylindrical shaped outer surface, a distal end portion and a proximal end portion that define a longitudinal axis. The main shaft includes an intermediate stop, a first stop and a second end stop. The intermediate stop is located at a predetermined position between the first stop and the second stop. A pair of grips are connected to the main shaft and slide relative to the main shaft. The movement of each grip is independent of the other grip. The movement of each grip is limited by the intermediate stop and one of the end stops on the main shaft. A bias mechanism is positioned on the main shaft between each end stop and grip. The bias mechanism interfaces with the grips and urges the grips away from the end stops and towards the intermediate stop. The bias mechanism is preferably two compression springs. The compression springs are preferably relatively weak compression springs. The bias mechanisms do not restrict the axial rotational movement of the grips, but solely provide a longitudinally directed bias.

The main shaft of the swing training apparatus can extend beyond the end stops or include a second shaft that extends longitudinally from one of the end stops of the main shaft. A simulator can be connected to the distal end portion of the main shaft that provides a visual indication of the alignment of the training apparatus that can simulate a golf club head or other athletic equipment that have a two-handed swing.

The main shaft can include a channel that interfaces with each grip. The channels can define the longitudinal travel of each grip along the main shaft and rotational travel of each grip about the longitudinal axis of the main shaft. The intermediate stop can be defined by one or more of a cushioned disc, the inward terminal end of the channels or the abutting of the grips directly against one another.

In a first position of the swing training apparatus, the grips are urged by the bias mechanism in an inward direction into contact with the intermediate stop. This position defines an initial position and a forward swing position. A second position of the swing training apparatus includes the grips moved outwardly along the longitudinal axis from the initial position to a position in proximity to the end stops of the main shaft.

A method of using a swing training apparatus comprises providing a swing training apparatus to a user that could be, for example, a golf, baseball, hockey or cricket player. The swing training apparatus has a main shaft with a cylindrical shaped outer surface, a proximal end portion and an opposed distal end portion. The proximal end portion and distal end portion define a longitudinal axis of the main shaft of the swing training apparatus. An intermediate stop and a pair of end stops are located on the main shaft. The intermediate stop is at a predetermined location between the end stops. The end stops may or may not be located in the proximal end portion and the distal end portion of the main shaft. The main shaft defines a channel. The swing training apparatus includes a pair of grips and each grip can slide longitudinally on the main shaft between the intermediate stop and one of the end stops. The channel for each grip defines the longitudinal travel and the axial rotation of the grip. A bias mechanism is connected to the main shaft and is positioned to urge the grips towards the intermediate stop. The bias mechanism is preferably positioned between a location in proximity to each end stop and the grip.

A first position of the swing training apparatus includes the player positioning their hands on each of the grips and placing a force on each grip in the longitudinal direction that is inwardly directed towards the intermediate stop. The first position preferably includes the distal hand of the player pulling the first grip into the intermediate stop and the proximal hand pushing the second grip into the intermediate stop. The player then executes a back swing that includes transitioning the inwardly directed force on each of the grips in the first position to placing an outwardly directed force on each grip along the longitudinal axis and away from the intermediate stop to displace the grips along the longitudinal axis to the second position.

A second position of the swing training apparatus preferably includes the distal hand of the player pushing the first grip into the second stop for the first grip and the proximal hand pulling the second grip into the second stop for the second grip. The player then executes a forward swing that includes transitioning the outwardly directed force on each of the grips in the second position to placing an inwardly directed force on each grip along the longitudinal axis and towards the intermediate stop to displace the grips to the first position in apposition with the intermediate stop.

A forward swing by the user from the second position to the first position includes the hands of the user of the sport training apparatus transitioning from the first hand on the first grip distal to the intermediate stop pulling the first grip to the intermediate stop and the second hand on the second grip proximal to the intermediate stop pushing the second grip to the intermediate stop. During the back swing and the forward swing of the swing training apparatus, the channel guides control the longitudinal travel of the grips between the first position and the second position and the axial travel of the grips about the longitudinal axis of the main shaft and/or between the first position and the second position. The main shaft can have an extended length or a second shaft. The second shaft is connected to the main shaft. The second shaft or the main shaft can further include a simulator that, depending upon the intended application, simulates a feature of one the simulated sports equipment such as the size and weight of a club head or the head of a baseball bat.

DETAILED DESCRIPTION OF THE INVENTION

Figure 1:
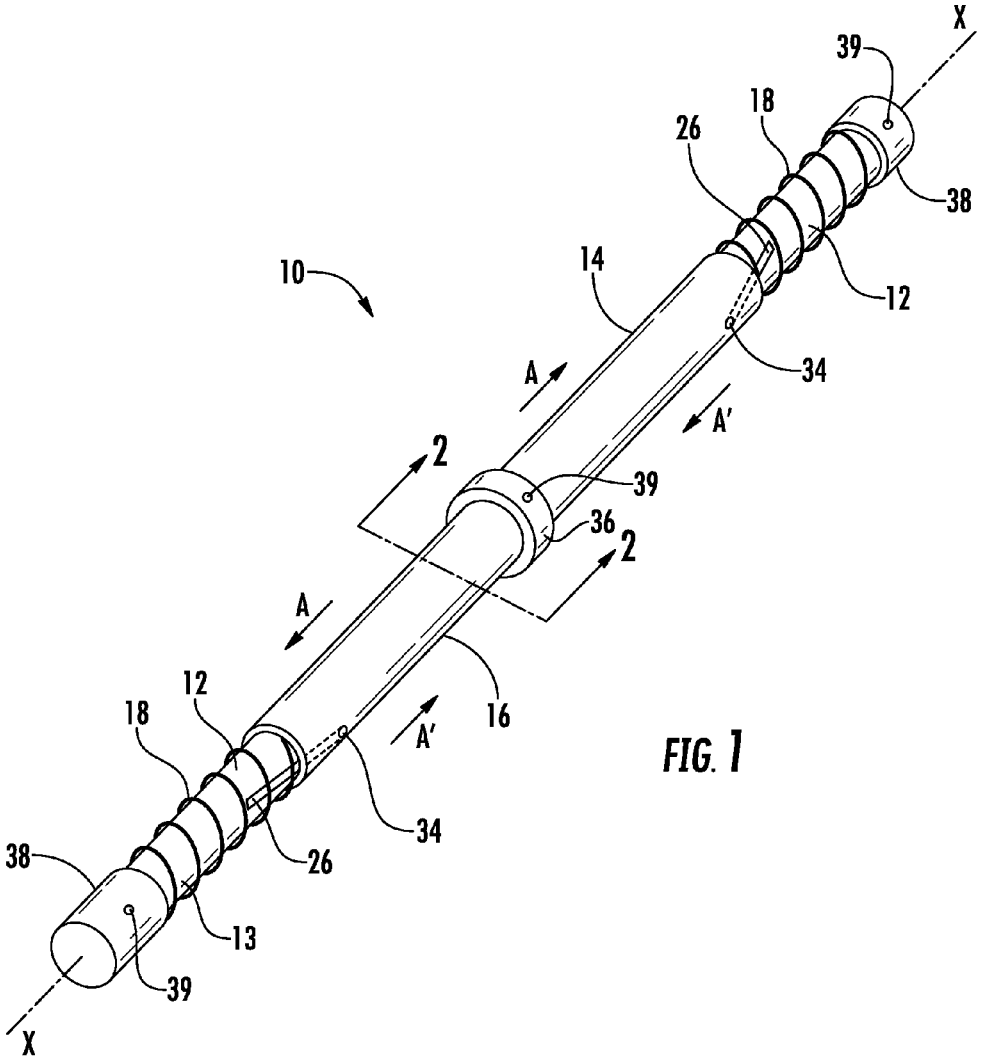
FIG. 1 is a front, side and proximal end perspective view of the sport swing training aid in a first position in accordance with the present disclosure.

As shown initially in FIG. 1, the sports swing training aid apparatus 10 includes a main shaft 12, a first grip 14, a second grip 16 and a bias mechanism 18. Grips 14 and 16 slide on main shaft 12. Grips 14 and 16 are biased to a first position of sport swing training aid apparatus 10 or training apparatus 10.

Figure 2:
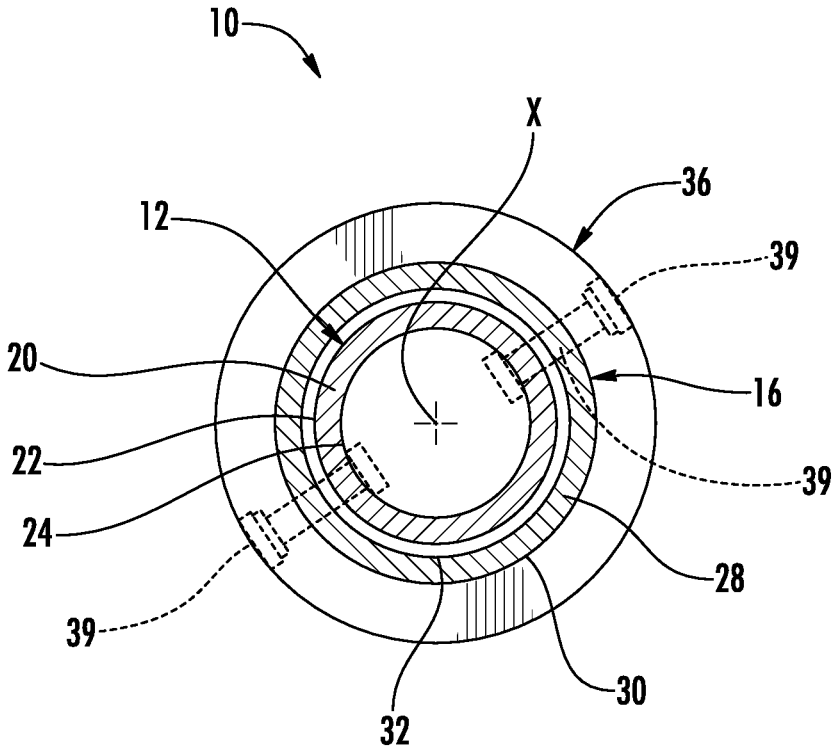
FIG. 2 is a cross-sectional view of the sport swing training aid of FIG. 1 taken along lines 2-2.

Referring to FIGS. 1 and 2, main shaft 12 has a cylindrically outer shape that extends between two opposed terminal end portions 13. Terminal end portions 13 are also a distal end portion and a proximal end portion. Main shaft 12 is preferably tubular shaped with a tubular wall 20. Main shaft 12 defines a longitudinal axis-X that is aligned with the opposing (proximal and distal) end portions 13 of main shaft 12. Main shaft 12 includes an outer surface 22 of tubular wall 20 and an inner surface 24 of tubular wall 20. Main shaft 12 can be a solid rod or a tube. Main shaft 12 could be made of any of a broad range of materials that provide the structural integrity for use as the main shaft 12 of training apparatus 10. Main shaft 12 can be constructed of natural materials such as wood, wood composites and rock or bonded natural materials such as for example ceramics, for example, as well as man-made materials such as, but not limited to polymers, glass materials, fiber based materials, composites, metals, etc. or any combination thereof.

Main shaft 12 preferably defines one or more longitudinally extending channels 26. Channels 26 can extend from or be defined in main shaft 12. Channels 26 can for example be structures that extend radially outwardly from tubular outer surface 22, structures that extend radially inwardly from tubular inner surface 24 of main shaft 12 or be apertures, such as slots, defined in tubular wall 20. Each channel 26 guides the movement of first grip 14 and second grip 16. The movement of grip 14 and grip 16 along channel 26 can be solely longitudinal or longitudinal and radial. Channels 26 can optionally provide frictional resistance, be partially interrupted or continuous. Channels 26 can also define the limit of longitudinal travel of first grip 14 and second grip 16 on main shaft 12. In the preferred embodiment, each channel solely guides the movement of each grip 14 and grip 16.

The one or more channels 26 defined by main shaft 12 can have a broad range of structural shapes. For example, channel 26 can be aligned with the longitudinal axis-X on main shaft 12, be aligned transverse to the longitudinal axis of main shaft 12, have a spiral shape, have arcuate portions or any variation thereof that provides the desired movement of grip 14 and grip 16 on main shaft 12 for a desired application of training apparatus 10. In one preferred embodiment as shown in FIG. 1, main shaft 12 has two opposing channels 26 that are approximately four (4) degrees transverse to the central longitudinal axis-X. In another preferred embodiment, there is a threaded interface between main shaft 12 and grip 14 and grip 16 that defines the axial and longitudinal travel.

Channels 26 are defined and located on main shaft 12 to interface with grip 14 and grip 16. Grip 14 and grip 16 mate with the one or more channels 26. Channels 26 can be constructed to control the movement of grips 14 and 16 on main shaft 12. For example, channels 26 can control the distance of the longitudinal travel of grip 14 and grip 16 on main shaft 12 and/or the rotational movement/travel of grip 14 and grip 16 on main shaft 12. In the preferred embodiment of training apparatus 10, channel 26 is one or more apertures defined in tubular wall that are through slots.

Grip 14 and grip 16 are cylindrically shaped tubes with a tubular wall 28, an outer surface 30 of tubular wall 28 and an inner surface 32 of tubular wall 28. Grip 14 and grip 16 are preferably made of synthetic and/or rubber material. The outer surface 30 of grip 14 and grip 16 can include ergonomic shapes and/or surfaces that enhance the use of training apparatus 10. The inner surface 32 of tubular walls 28 of grip 14 and grip 16 have a slidingly interface with the outside diameter of the outer surface 24 of tubular wall 20 of main shaft 12. The sliding interface between grip 14 and grip 16 and main shaft 12 can include a low friction inner wall surface 32 of grip 14 and grip 16, but could also include additional structures and/or chemical enhancements to inner wall surface 32 to reduce friction. Grip 14 and grip 16 are securely connected to main shaft 12 in an independently sliding relationship that can includes at least longitudinal movement and can further include rotational movement on main shaft 12.

The secure sliding connection between main shaft 12 and grip 14 and grip 16 can be any means. The outside diameter of main shaft 12 and inside diameter of grip 14 and grip 16 can be in close proximity so as to provide a close sliding preferably low friction interface. Main shaft 12 and grip 14 and grip 16 can define an interface that mates such as a locking tongue and groove, slot and extension or slot and connector. The mating interface between main shaft 12 and grip 14 and grip 16 can provide limits or stops to the longitudinal travel as well as the axial rotation of grip 14 and grip 16 on main shaft 12.

In the preferred embodiment of main shaft 12, channel 26 is a slot in tubular wall 20 that receives a connector 34. Grip 14 and grip 16 define an aperture that receives connector 34 that extends through channel 26 of tubular wall 20 of main shaft 12. Each connector 34 is secured in position through grip 14 and grip 16. In this preferred embodiment, the threads of connector 34 mate with a threaded nut fastener to secure grip 14 and grip 16 with main shaft 12. The threaded nut is preferably a lock nut.

The secure sliding connection between grip 14 and grip 16 and main shaft 12 can include one or more structures such as layers, spacers, bearings or washers. The structures such as the spacers, for example, can perform functions such as reducing the concentration of the load by the head of connector 34 on grip 14 and grip 16 and/or that of the nut for connector 28 on main shaft 12. The spacer can also facilitate the sliding of grip 14 and grip 16 relative to main shaft 12. It is understood, that each grip 14 and grip 16 can employ one or more connectors 34, spacers and fasteners. Further, the spacers can connect with grip 14, grip 16 or main shaft 12.

In an alternative embodiment, grip 14 and grip 16 define a wall that extends in an approximately radial direction from tubular grip 14 and grip 16 that mates with and extends through channel 26 of main shaft 12. The grip 14 and grip 16 wall and channel 26 interface provides a secure sliding connection with main shaft 12. The inwardly extending wall of grip 14 and grip 16 can have a terminal end portion that is deformable such that it compresses to pass through the slot that is channel 26 and then expands to make a snap fitting type engagement with main shaft 12. The grip 14 and grip 16 interface with main shaft 12 can also include threads.

The limits of movement of grip 14 and grip 16 on main shaft 12 can include the selective use of one or more stops that limit the range of the sliding movement of grip 14 and grip 16 on shaft 12. In one preferred embodiment, main shaft 12 has an intermediate stop 36 and a pair of opposing end caps 38. The intermediate stop 36 limits the movement of grip 14 and grip 16 in an inward direction (Arrow A') on main shaft 12 to the opposing sides of intermediate stop 36. Intermediate stop 36 preferably includes a cushioning type structural element. Intermediate stop 36 can be made of rubber, a resilient polymer or have a resilient structure for example, that terminates the inwardly directed movement of grip 14 and grip 16 on master shaft 12. Channels 26 can also limit the movement of grip 14 and grip 16 alone or in combination with intermediate stop 36 and end caps 38.

End caps 38 connect to the opposing terminal end portions 13 of main shaft 12. End caps 38 can be located on main shaft 12 terminal end portions 13 to limit the outwardly directed (Arrow A) travel of grip 14 and grip 16. End caps 38 can be made of any material such as for example the same material as main shaft 12 or a different material. End caps 38 can connect to main shaft 12 by any means to include but not limited to bonding by adhesives or heat, friction, bias, threading interface between end cap 38 and main shaft 12, a mechanical connection using a connector as described above using one or more connectors 39. Each end cap 38 at least partially covers one of the distal end portion of main shaft 12.

End caps 38 can connect to terminal end portions 13 or end caps 38 can be second caps 38 or second stops 38 that can be positioned at other locations on main shaft 12 relative to intermediate stop 36 and independent of being in proximity to terminal end portion 13. The location of second cap, second stop or end cap 38 can depend upon the length of main shaft 12 and the desired application of training apparatus 10. Alternatively, main shaft 12 can define a lip or other structure at any location that can, for example, define a lip that functions as end cap, second cap or second stop 38 that limits the travel of grip 14 or grip 16.

Bias mechanism 18 is positioned between first grip 14 and the end cap 38 associated with grip 14 and second grip 16 and the end cap 38 associated with grip 16. Bias mechanism 18 urges grip 14 and grip 16 towards intermediate stop 36 and opposite the direction of arrow-A'. Bias mechanism 18 is preferably a compression spring. In one preferred embodiment, bias mechanism is an open coil helical spring positioned concentric with the longitudinal axis-X and adjoining the outer surface 22 of main shaft 12. Bias mechanism 18 in the preferred embodiment has an approximately two and a half (2.5) inch length and is compressed to two (2) inches between each respective end stop 38 and grip 14 and grip 16. Continuing with the preferred embodiment, bias mechanism 18 is not connected to end stop 38, grip 14 or grip 16. Bias mechanism 18 does not bias the rotational movements of grip 14 and grip 16 about the longitudinal axis. It is understood, however, bias mechanism 18 can be any kind of bias device to include resilient materials that urge grip 14 and grip 16 towards intermediate stop 36. Similarly, bias mechanism 18 can be positioned inside of tubular main shaft 12 so as to urge first grip 14 and second grip 16 towards intermediate stop 36.

Figure 3:
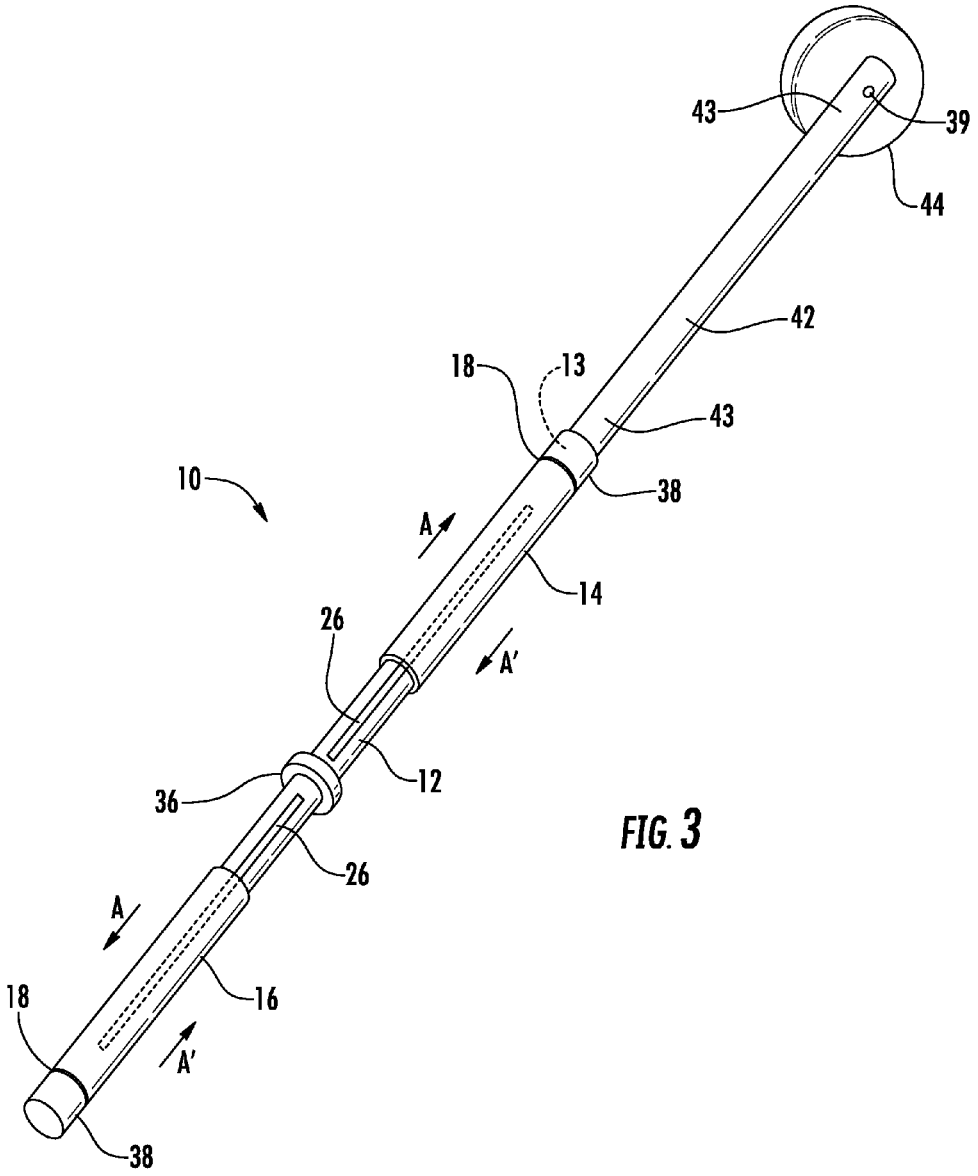
FIG. 3 is a front, side and proximal end perspective view of the sport swing training aid of FIG. 1 in a second position.
Figure 4:
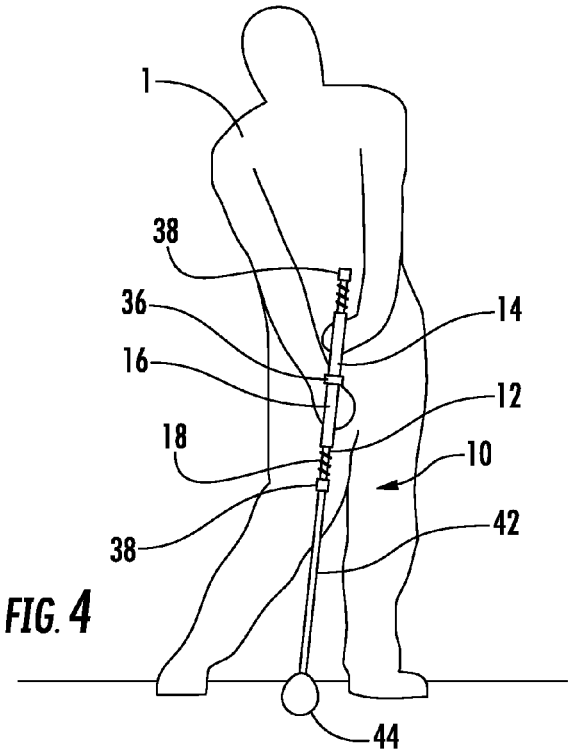
FIG. 4 is a simplified image of a person using the sport swing training aid of FIG. 3 in a first position for golf swing training.
Figure 5:
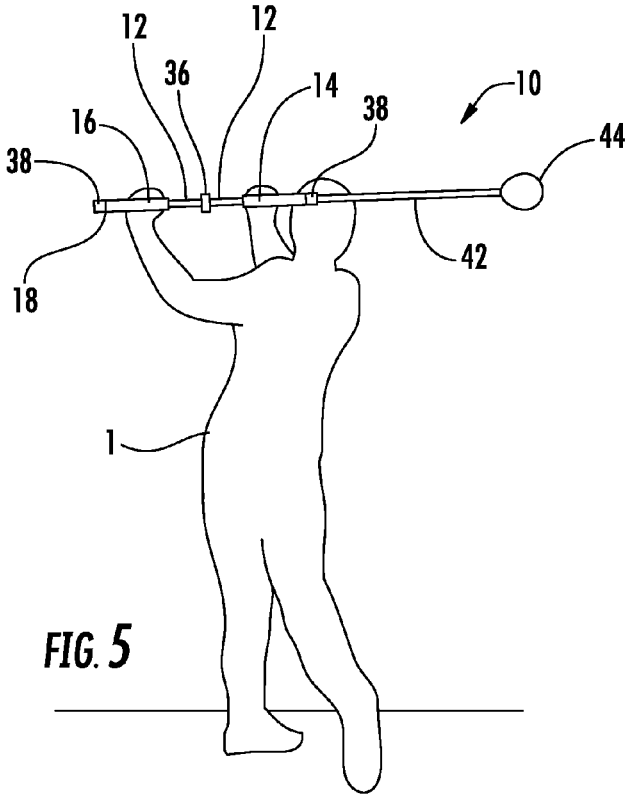
FIG. 5 is a simplified image of a person using the sport swing training aid of FIG. 3 in a second position for golf swing training.
Figure 6:
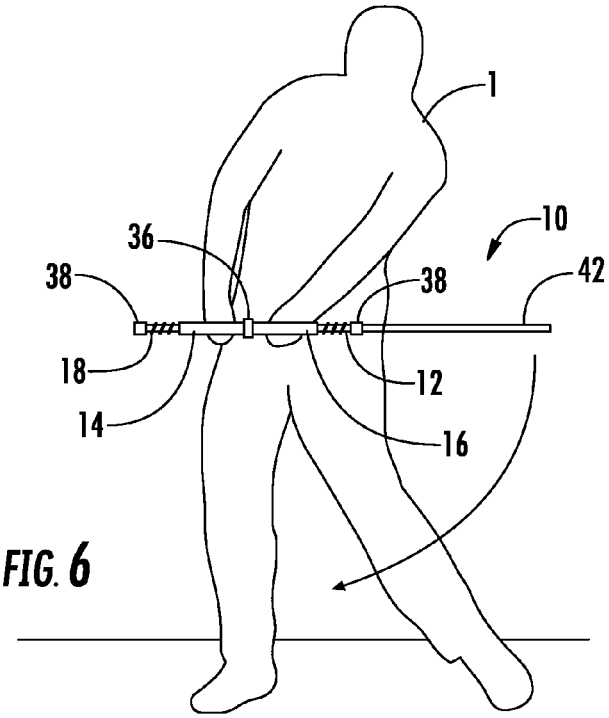
FIG. 6 is a simplified image of a person using the sport swing training aid of FIG. 1 in a first position for baseball bat swing training.
Figure 7:
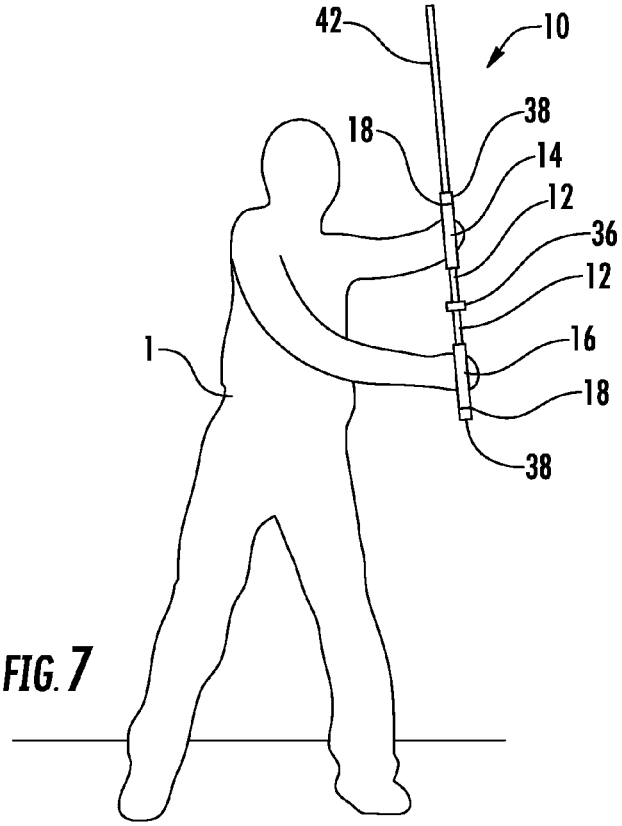
FIG. 7 is a simplified image of a person using the sport swing training aid of FIG. 1 in a second position for baseball bat swing training.

As shown in FIG. 3, one or more channels 26 shown as two separate channels can vary in their length and alignment. In this one preferred embodiment, channels 26 have an extended length that can aid in select training applications in which it desirable that grip 14 and grip 16 can have an increased separation in the second position of training apparatus 10. The alignment of channels 26 relative to the longitudinal axis can also be constructed to selectively benefit certain types of swings. It is understood that main shaft 12 can include multiple sets of channels 26 with each set of channels defined for specific applications that can result in advantageous swing benefits.

As an alternative to one or both of end caps 38 for terminal end portions 13, end cap 38 can include a second connector that connects main shaft 12 to an optional second shaft 42. Second shaft 42 is preferably aligned with the longitudinal axis-X and main shaft 12. End cap 38 that is also a second connector can also limit the outward travel of grip 14 or grip 16 on main shaft 12 similar to end cap 38. Each end cap 38 can further include a cushioning element as described above for intermediate stop 36 that resiliently terminates the outwardly directed movement of grip 14 and/or grip 16.

Second shaft 42 can connect to end cap 38 by any means to include those described above for the connection between end cap 38 and main shaft 12. Second shaft 42 preferably includes two opposing terminal end portions 43. One terminal end portion 43 connects to the end cap 38 connector and the opposing terminal end portion 43 is a free end. Second shaft 42 can be a solid rod or tubular structure. Second shaft 42 can extend within main shaft 12 and be selectively adjust in length by moving second shaft 42 relative to main shaft 12. Thus, second shaft 42 can have a fixed or variable length. As an alternative, for example, second shaft 42 can have multiple short segments that can telescope to vary the length of second shaft 42.

Second shaft 42 can optionally include a simulator 44. Simulator 44 is preferably located on or in proximity to the free terminal end portion 43. Simulator 44 can have any structure, but preferably has the shape of a disc that provides a visual orientation of the directional alignment simulator 44 relative to mains shaft 12 of training apparatus 10 along axis-X. This is particularly advantageous for the golf application of training apparatus 10. Alternative structures for simulator 44 include a golf head shape. Simulator 44 is preferably made of a polymer, but it is understood that stimulator 44 could be made of any material to include natural materials such as cellulose as well as metal, glass, fibers, ceramic and composites.

In one preferred embodiment, the baseball application of the training apparatus 10, main shaft 12 has a length of approximately seventeen and a half (17.5) inches and an outside diameter of approximately 0.84 inches and an inside diameter of approximately one half (0.5) inch. First grip 14 and second grip 16 have lengths of approximately six (6) inches, an outside diameter of approximately one (1) inch and an inside diameter of approximately 0.88 inch. Bias mechanism 18 is two compression springs each provides a close fitting relationship with main shaft 12, interfaces with first grip 14 and second grip 16, respectively for compression on main shaft 12 and has a length of approximately two and a half (2.5) inches long. The one or more channels 26 as described above preferably have a length of two and a half (2.5) inches.

Optional second shaft 42 has an overall length of sixteen and one half (16.5) inches, an outside diameter of approximately 0.8 inch and a connection with one of end caps 38 and/or directly to main shaft 12 that can be by any means as described below for end cap 38. A connector 39 attaches optional disc 44 to second shaft 42. Disc 44 has an approximately three (3) inch diameter and is approximately one eighth (0.125) inch thick.

Continuing with the preferred embodiment for the baseball application of training apparatus 10, optional second shaft 42 has an overall length of sixteen and one half (16.5) inches, an outside diameter of approximately 0.84 inches and a connection with one of end caps 38 and/or directly to main shaft 12 that can be by any means as described below for end cap 38. A connector 39 attaches optional disc 44 to second shaft 42. Disc 44 has an approximately three (3) inch diameter and is approximately one eighth (0.125) inch thick.

The preferred embodiment for the golf application of training apparatus 10 includes a main shaft 12 that has a length along the longitudinal axis of approximately eighteen (18) inches, an outside diameter of approximately six tenths (0.6) of an inch and an inside diameter of approximately one half (0.5) inch. First grip 14 and second grip 16 are approximately six (6) inches in length along the longitudinal axis, an outside diameter of approximately three-fourths (0.75) inch and an inside diameter of approximately one half (0.5) inch.

Second shaft 42 in golf application of training apparatus 10 has the same overall length of sixteen and one half (16.5) inches, an outside diameter of approximately 0.8 inch and a connection with one of end caps 38 and/or directly to main shaft 12 that can be by any means as described below for end cap 38. A connector 39 attaches simulator 44 to second shaft 42. Simulator 44 is preferably an approximately three (3) inch diameter disc and is approximately one eighth (0.125) inch thick, but it is understood that simulator 44 can have any structure to include any type of golf club head.

In operation as shown in FIGS. 1-7, training apparatus 10 teaches the active use of a two handed grip on athletic equipment for the building of kinesthetic memory for the development of advantageous skills with the desired athletic equipment. Grips 14 and 16 provide actual dynamic movement relative to main shaft 12 that simulates one preferred muscular development associated with desirable athletic equipment swings such as those for golf, baseball, hockey, cricket, lacrosse and tennis (at times).

In the baseball application of training apparatus 10 for a right handed batter or user, these movements include a left hand of the user or batter holding second grip 16 and the right hand of the user holding first grip 14. Training apparatus 10 in a first position includes the batter holding first grip 14 and second grip 16 and pulling the first grip 14 and pushing second grip 16 inwardly or together against intermediate stop 36 as urged by bias mechanism 18. As the batter begins to reposition training apparatus 10 into a batting stance position or a second position, the batter gradually reverses his pulling and pushing forces on first grip 14 and second grip 16, respectively to an outward or pulling force on grip 16 and pushing force on grip 14 that moves grip 14 and grip 16 outward from intermediate stop 36 towards their respective end cap 38. As the batter begins his swing of the training apparatus 10 from the second position to the first position, the batter again gradually reverses the force on grip 14 and grip 16 to a inwardly directed pulling force that drives grip 14 and inwardly directed pushing force that drives grip 16 into contact with intermediate stop 36 and into the first position.

In the golf application of training apparatus 10 for a right-handed golfer or user, these movements include a left hand of the user or golfer holding second grip 16 and the right hand of the user holding first grip 14. Training apparatus 10 in the first position further includes the golfer in a set up type stance holding first grip 14 and second grip 16 and pulling the first grip 14 and pushing second grip 16 inwardly or together against intermediate stop 36 as urged by bias mechanism 18. As the golfer begins to reposition training apparatus 10 into the back swing, the golfer gradually reverses their pulling and pushing forces on first grip 14 and second grip 16, respectively to an outward or pulling force on grip 16 and pushing force on grip 14 that moves grip 14 and grip 16 outward from intermediate stop 36 towards their respective end cap 38 on main shaft 12. As the golfer begins their swing of training apparatus 10, the golfer again gradually reverses the force on grip 14 and grip 16 to an inwardly directed pulling force that drives grip 14 and inwardly directed pushing force that drives grip 16 into contact with intermediate stop 36.

In operation, the synchronizing of the respective inwardly directed and opposing pushing and pulling movements of the user's hands provides critical kinesthetic memory building that can assist the athlete in further developing their swinging skills. In the above applications, first grip 14 and second grip 16 can be free to slide longitudinally and rotate axially around the longitudinal axis, slide only longitudinally as a result of the longitudinal alignment of channels 26 that prevent the rotation of grip 14 and grip 16 or slide longitudinally and rotate a select amount as a result of the alignment of channels 26.

The one or more channels 26 assist the user or athlete in keeping their forearms and hands in position during the backswing and the transition that is made between the backswing and the forward swing. Training apparatus 10 assists a right-handed golfer, for example, by aiding in the aligning of the right forearms and hand and left forearm and hand in the backswing. In particular, in the back swing the right hand is in a supination position and the left hand in a pronation position. Training apparatus 10 aids the golfer in that alignment and the alignment in the transition that is made from the backswing or the second position through the forward swing or first position. In the backswing the right forearm and hand grip is gradually turned from a supination to a pronation and the left forearm and hand grip is turned from a pronation to a supination. The transitional alignments of the forward swing continue in the follow through after the ball is struck. One preferred embodiment of training apparatus 10 is the channel 26 opposing mirror image four degree (4°) angle offset from the longitudinal axis as shown in FIG. 1 that can be particularly beneficial to the golf application that demands precise control of the position of the face of simulator 44.

It is understood that when practicing, golfers are known to check the position of their hands and the club head position on the intermediate point of the backswing. Simulator 44, as shown in FIG. 3 as a round disc, provides the golfer when viewing their swing at an intermediate point a better view of their alignment of the club vice attempting to perceive the alignment of the slanted blade of the club head at the intermediate point of the backswing.

In addition, it is understood that the channel 26 interface with grip 14 and grip 16 could include the variations in channel 26 alignments. For example, while channels 26 in FIG. 1 are shown as having an intersecting mirror image alignment and FIG. 3 shows an extended length channel 26 aligned with the longitudinal axis, it is understood that variations thereof such as channels 26 transverse to the longitudinal axis and parallel and/or aligned could facilitate specialized grip situations in golf where supination of the forearms and hands are not desirable such as in the practice of sand shots. In these types of applications in golf, the lead hand stays palm down and the trailing hand stays palm up.

Further, the mating interface between the one or more channels 26 and grip 14 and grip 16 can include multiple channels that accommodate the channel 26 alignment and length variations described above in a single main shaft 12 that can be selectively employed by the user. Similarly, grip 14 and grip 16 can be alternated between left and right handers and second shaft 42 can be configured to be connected with either of the opposing end caps 38.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, while the present disclosure is discussed in terms of a main shaft and a second shaft, it is understood that training apparatus 10 can be a single extended main shaft 10. While the present disclosure is described in terms of a series of embodiments and applications for specific sports, the present disclosure can combine one or more novel features of the different embodiments into other sports beyond the applications identified herein. The specification and drawings are accordingly to be regarded in an illustrative manner rather than a restrictive sense.

What is claimed is:

1. A swing training apparatus that comprises:

a main shaft, the main shaft has a cylindrical shaped outer surface, the main shaft defines a longitudinal axis, an intermediate stop and a pair of end stops located on the main shaft, the intermediate stop at a predetermined location between the end stops, a channel defined by the main shaft;

a pair of grips, the grips connected to the main shaft, each grip slides longitudinally and radially on the main shaft, each grip positioned between the intermediate stop and one of the end stops on the main shaft, each grip independently movable, each grip interfaces with the channel for movement on the main shaft; and a bias mechanism, the bias mechanism connected to the main shaft, the bias mechanism positioned between each grip and the adjoined end stop for the grip, the bias mechanism urges the grip longitudinally towards the intermediate stop.

2. The swing training apparatus of claim 1 that further includes a second shaft that extends longitudinally from one of the end portions of the main shaft.

3. The swing training apparatus of claim 2 that further includes a simulator on the second shaft.

4. The swing training apparatus of claim 1, wherein the bias mechanism includes two separate compression springs, each compression spring positioned between the end stop and the adjoined grip, each spring solely urges the grips longitudinally into contact with the intermediate stop, the radial movement of each grip independent of the adjoined spring.

5. The swing training apparatus of claim 1, wherein the channel defines the longitudinal travel and rotational travel about the longitudinal axis of each grip on the main shaft, the channel defines the intermediate stop.

6. The swing training apparatus of claim 1, wherein the intermediate stop is a disc and the intermediate stop limits the travel of each grip.

7. A swing training apparatus that comprises:

a main shaft, the main shaft has a cylindrical shaped outer surface, the main shaft has a proximal end portion and an opposed distal end portion, the proximal end portion and distal end portion define a longitudinal axis of the main shaft;

an intermediate stop and a pair of end stops located on the main shaft, the intermediate stop at a predetermined location between the end stops;

a channel, the channel defined by the main shaft;

a pair of grips, the grip slide longitudinally and radially on the main shaft, each grip positioned between the intermediate stop and one of the end stops on the main shaft, the grips connected to the channel of the main shaft, each grip independently movable relative to the other grip, each grip interfaces with the channel for movement on the main shaft; and a bias mechanism, the bias mechanism positioned between each end stop and the adjoined grip, the bias mechanism urges the grip towards the intermediate stop.

8. The swing training apparatus of claim 7, wherein the main shaft extends past at least one of the end stops and further includes a simulator in proximity to the distal end of the main shaft.

9. The swing training apparatus of claim 7, wherein the channel defines the intermediate stop and the end stops.

10. The swing training apparatus of claim 7, wherein the intermediate stop and the end stops are independent of the channel.

11. The swing training apparatus of claim 7, wherein the bias mechanism includes two separate compression springs, each compression spring positioned between the end stops and the adjoined grip, each bias mechanism urges the adjoined grip into the intermediate stop, the rotational movement of the grips unrestricted by the bias mechanism.

12. The swing training apparatus of claim 7, wherein the grips in a first position are in direct contact.

13. The swing training apparatus of claim 7, wherein the grips in a first position are in direct contact with the intermediate stop.

14. A method of using a swing training apparatus, the method comprising the following steps:

providing a swing training apparatus, the swing training apparatus comprising a main shaft, the main shaft has a cylindrical shaped outer surface, the main shaft has a proximal end portion and an opposed distal end portion, the proximal end portion and distal end portion define a longitudinal axis of the main shaft, the main shaft includes an intermediate stop and two end stops, the intermediate stop located at a predetermined position between the end stops; the main shaft defines a channel; a first grip and a second grip, the grips slidable longitudinally on the main shaft, each grip positioned between the intermediate stop and one of the end stops on the main shaft, the grips connected to the main shaft, the channel for each grip defines the movement of the grip on the main shaft; and a bias mechanism, the bias mechanism positioned on the main shaft between the end stop and the grip, the bias mechanism urges the grip towards the intermediate stop;

gripping the sport training apparatus in a first position, the sport training apparatus biased to the first position that includes the grips in contact with the intermediate stop, a first hand of a user on the first grip distal to the intermediate stop and a second hand of the user on a second grip proximal to the intermediate stop, the first grip and the second grip in the first position; and executing a back swing, the user executing the back swing including swinging the swing training apparatus from the first position to the second position, transitioning from the first position to the second position, the hands of the user of the sports training apparatus transitioning from the first position to the second position including the first hand on the first grip pushing the first grip towards the end stop for the first grip against the bias of the bias mechanism and the second hand pushing the second grip towards the second end stop for the second grip against the bias of the bias mechanism; and executing a forward swing, the user executing the forward swing including swinging the swing training apparatus from the second position to the first position, the hands of the user of the sport training apparatus transitioning from the first hand on the first grip distal to the intermediate stop pulling the first grip to the intermediate stop and the second hand on the second grip proximal to the intermediate stop pushing the second grip towards the intermediate stop.

15. The method of using a swing training apparatus of claim 14 wherein the transitioning between positions includes the grips interfacing with the channel and moving the grips longitudinally between the first position and the second position.

16. The method of using a swing training apparatus of claim 14 wherein the transitioning between positions includes the grips interfacing with the channel and rotating the grips about the main shaft between the first position and the second position.

17. The method of using a swing training apparatus of claim 14 wherein the swing training apparatus further includes an extended main shaft.

18. The method of using a swing training apparatus of claim 17 wherein the swing training apparatus further includes a simulator in proximity to the distal end portion of the main shaft, the user using the simulator to indicate the alignment of the swing training apparatus.

19. The method of using a swing training apparatus of claim 14 wherein the swing training apparatus simulates a baseball bat.

20. The method of using a swing training apparatus of claim 14 wherein the swing training apparatus simulates a golf club.

* * * * *